US006036047A

United States Patent [19]

Dobbie

[11] Patent Number: 6,036,047

[45] Date of Patent: Mar. 14, 2000

[54] THERMAL WRAP FOR COOLERS

[76] Inventor: Kathryne Dobbie, 1285 Tropical Ave., Pasadena, Calif. 91107

[21] Appl. No.: 09/193,806

[22] Filed: Nov. 17, 1998

[51] Int. Cl.[7] ..... B65D 23/08

[52] U.S. Cl. ..... 220/592.03; 220/739; 220/903; 150/154; 150/901

[58] Field of Search ..... 150/154, 901; 220/739, 903, 592.03

[56] References Cited

U.S. PATENT DOCUMENTS

| | | | |
|---|---|---|---|
| 3,579,647 | 5/1971 | Nielson | 150/901 |
| 3,589,971 | 6/1971 | Reed | 150/901 |
| 5,048,734 | 9/1991 | Long | 150/901 |
| 5,609,265 | 3/1997 | Haberkorn et al. | 150/901 |
| 5,680,944 | 10/1997 | Rueter | 150/901 |

*Primary Examiner*—Joseph M. Moy

*Attorney, Agent, or Firm*—Golstein & Canino

[57] ABSTRACT

A thermal wrap for coolers including a base portion fabricated of an insulated material. The base portion is dimensioned for wrapping around forward, rearward and opposing side walls of a cooler. The base portion includes a forward portion, a rearward portion, a first side portion, and a second side portion. The forward portion has a free leading edge and a trailing edge. The trailing edge is integral with a leading edge of the first side portion. A trailing edge of the first side portion is integral with a leading edge of the rearward portion. A trailing edge of the rearward portion is integral with a leading edge of the second side portion. A cover member is provided that is dimensioned for coupling with a removable cover of the cooler. The cover member has a rectangular main panel. The main panel has a pair of opposed foldable long edges and a pair of opposed foldable short edges. The cover member is secured to the base member whereby the cooler is completely contained therein.

5 Claims, 2 Drawing Sheets

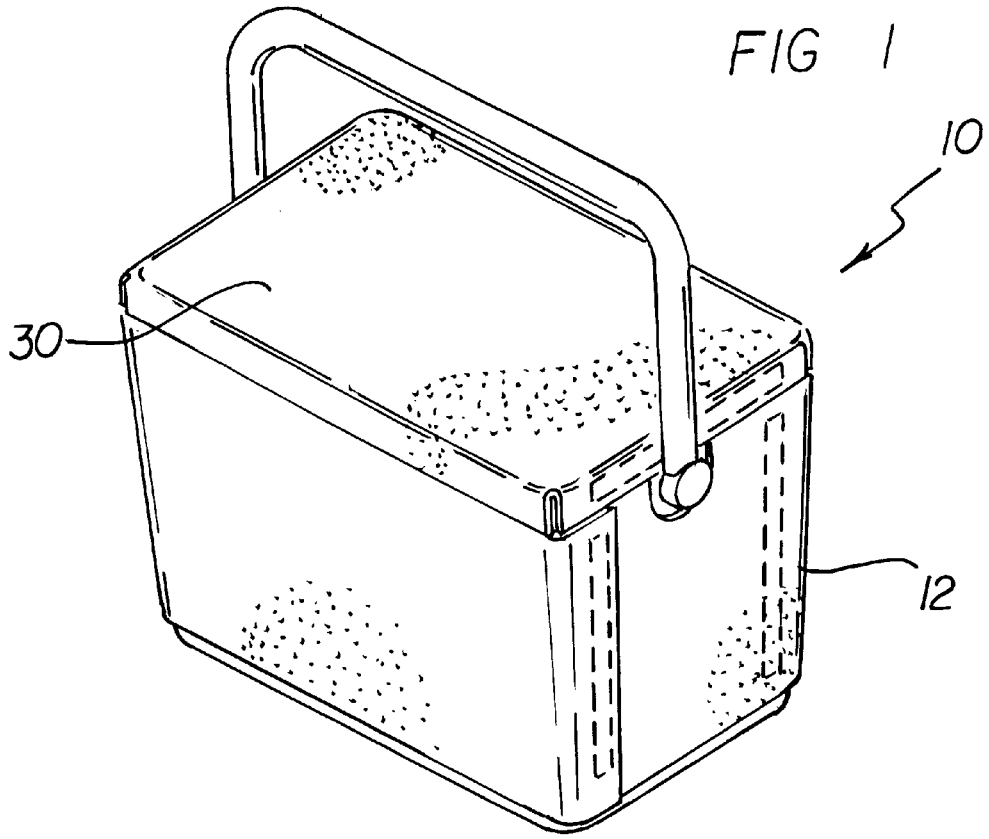
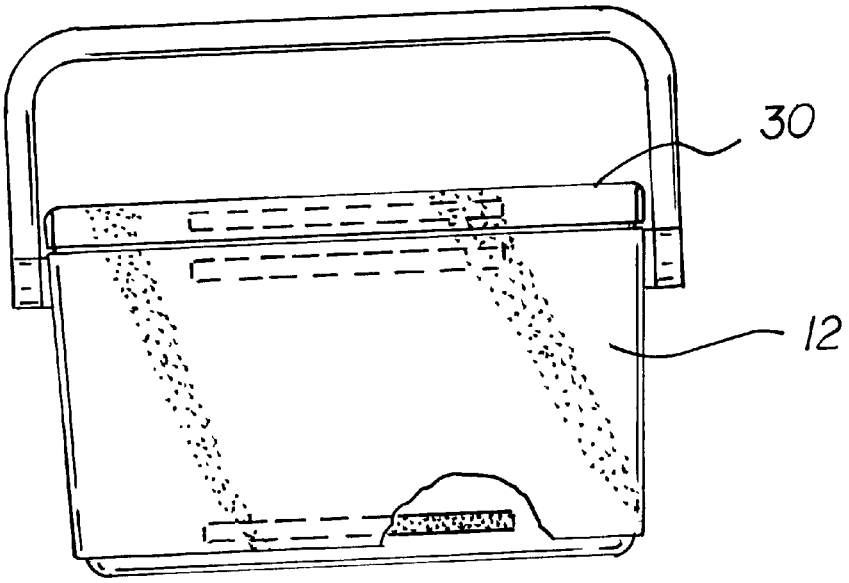
FIG 2

FIG 3
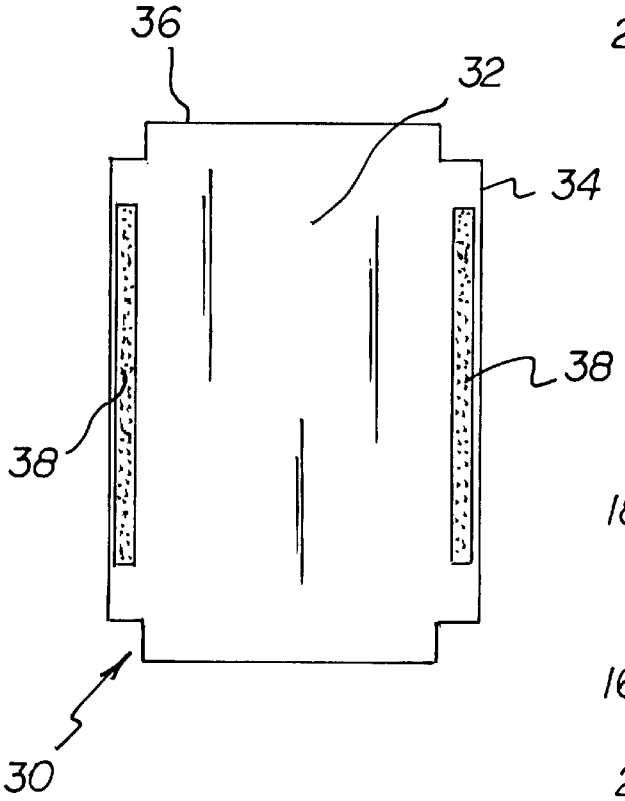
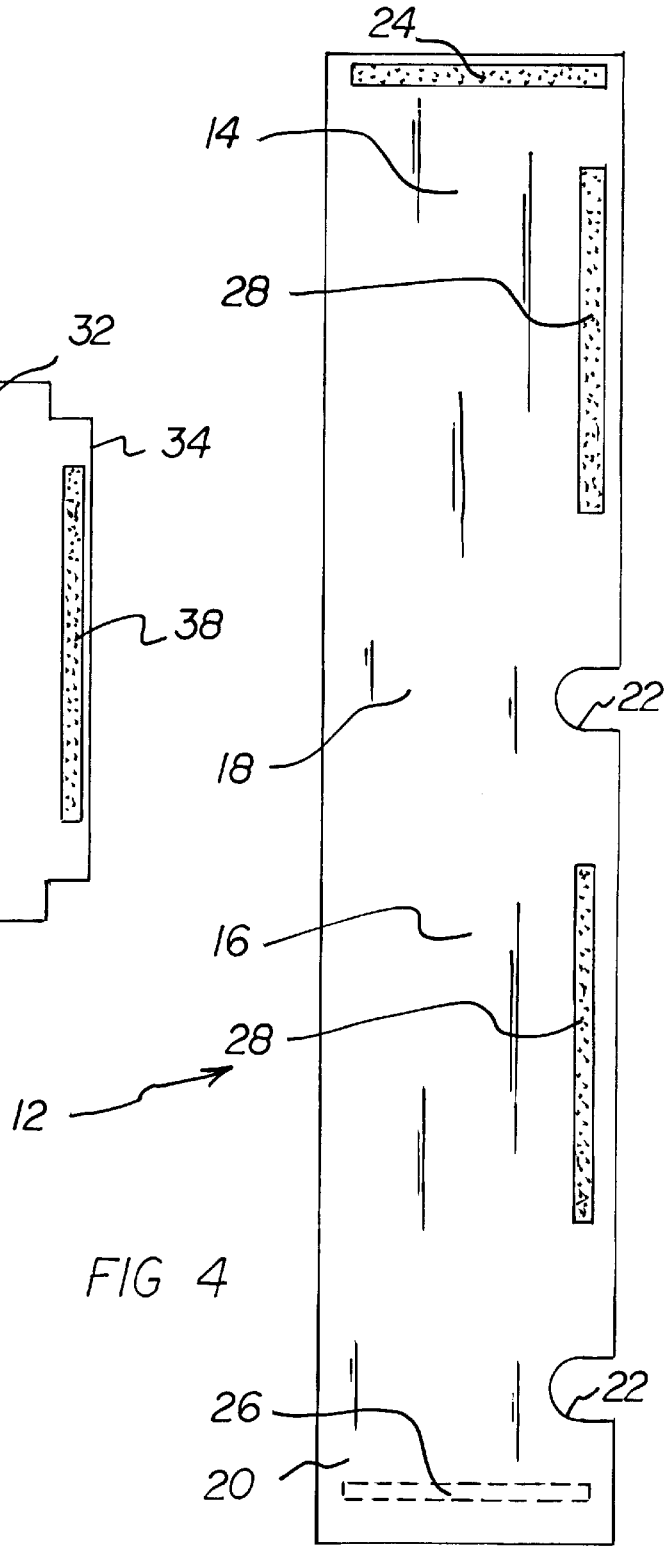
FIG 4

THERMAL WRAP FOR COOLERS

BACKGROUND OF THE INVENTION

The present invention relates to a thermal wrap for coolers and more particularly pertains to increasing the thermal insulation of a cooler to preserve ice and maintain a cooling period for items disposed within the cooler.

The use of personal coolers for picnics, travel, and other uses is constant. Coolers are also used for transporting medicine and organs for transport. The preservation of these items is of extreme importance, especially the latter. These items are usually placed within a cooler and filled with ice to protect these items.

A problem exists because ice always melt at a rate quicker than most people anticipate. Most times, people do not have access to more ice. Thus, risks of spoilage to food, the warming of beverages, and the danger of rendering medicine and organs for transport useless is great. A need exists to increase the life span of ice.

The use of protective thermal devices is known in the prior art. More specifically, protective thermal devices heretofore devised and utilized for the purpose of maintaining a cool temperature for foods and the like are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,050,264 to Tanaka discloses a refrigerating container comprised of multiple layers including an outer layer that appears to be a removable bag. U.S. Pat. No. 5,188,877 to Magaro discloses a thermal device comprised of a fabric with an insulating portion for wrapping around a bottle to insulate the contents. U.S. Pat. No. 4,892,226 to Abtahi discloses a storage case with a foldable material covering. U.S. Pat. No. 5,462,168 to Oberhelman discloses a beverage container cover suited to slip over a cardboard carton and maintain a cool temperature for the contents and to provide an ornate appearance. U.S. Pat. No. 5,216,900 to Jones discloses a soft sided cooler with a coolant material adapted for positioning therein.

While these devices fulfill their respective, particular objective and requirements, the aforementioned patents do not describe a thermal wrap for coolers for increasing the thermal insulation of a cooler to preserve ice and maintain a cooling period for items disposed within the cooler.

In this respect, the thermal wrap for coolers according to the present invention substantially departs from the conventional concepts and designs of the prior art, and in doing so provides an apparatus primarily developed for the purpose of increasing the thermal insulation of a cooler to preserve ice and maintain a cooling period for items disposed within the cooler.

Therefore, it can be appreciated that there exists a continuing need for new and improved thermal wrap for coolers which can be used for increasing the thermal insulation of a cooler to preserve ice and maintain a cooling period for items disposed within the cooler. In this regard, the present invention substantially fulfills this need.

SUMMARY OF THE INVENTION

In the view of the foregoing disadvantages inherent in the known types of protective thermal devices now present in the prior art, the present invention provides an improved thermal wrap for coolers. As such, the general purpose of the present invention, which will be described subsequently in greater detail, is to provide a new and improved thermal wrap for coolers and method which has all the advantages of the prior art and none of the disadvantages.

To attain this, the present invention essentially comprises a base portion fabricated of an insulated material. The base portion is dimensioned for wrapping around forward, rearward and opposing side walls of a cooler. The base portion includes a forward portion, a rearward portion, a first side portion, and a second side portion. The forward portion has a free leading edge and a trailing edge. The trailing edge is integral with a leading edge of the first side portion. A trailing edge of the first side portion is integral with a leading edge of the rearward portion. A trailing edge of the rearward portion is integral with a leading edge of the second side portion. The second side portion has a free trailing edge. The first side portion and the second side portion each have an arcuate recess extending inwardly of an upper edge thereof. The base portion has a strip of hook and loop material disposed on an outer surface of the forward portion inwardly of the leading edge thereof. The second side portion has a strip of hook and loop material disposed on an inner surface thereof inwardly of a trailing edge thereof for mating with the strip of hook and loop material of the forward portion for securement of the base member around the cooler. The forward portion and the rearward portion each have a strip of hook and loop material on an outer surface thereof downwardly of an upper edge thereof. A cover member is provided that is dimensioned for coupling with a removable cover of the cooler. The cover member has a rectangular main panel. The main panel has a pair of opposed foldable long edges and a pair of opposed foldable short edges. The long edges each have a strip of hook and loop material disposed on an inner surface thereof for mating with the strips of hook and loop material on the forward and rearward portions of the base member to facilitate securement of the cover member to the base member whereby the cooler is completely contained therein.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved thermal wrap for coolers which has all the advantages of the prior art protective thermal devices and none of the disadvantages.

It is another object of the present invention to provide a new and improved thermal wrap for coolers which may be easily and efficiently manufactured and marketed.

It is a further object of the present invention to provide a new and improved thermal wrap for coolers which is of durable and reliable construction.

An even further object of the present invention is to provide a new and improved thermal wrap for coolers which is susceptible of a low cost of manufacture with regard to both materials and labor, and which accordingly is then susceptible of low prices of sale to the consuming public, thereby making such a thermal wrap for coolers economically available to the buying public.

Even still another object of the present invention is to provide a new and improved thermal wrap for coolers for increasing the thermal insulation of a cooler to preserve ice and maintain a cooling period for items disposed within the cooler.

Lastly, it is an object of the present invention to provide a new and improved thermal wrap for coolers including a base portion fabricated of an insulated material. The base portion is dimensioned for wrapping around forward, rearward and opposing side walls of a cooler. The base portion includes a forward portion, a rearward portion, a first side portion, and a second side portion. The forward portion has a free leading edge and a trailing edge. The trailing edge is integral with a leading edge of the first side portion. A trailing edge of the first side portion is integral with a leading edge of the rearward portion. A trailing edge of the rearward portion is integral with a leading edge of the second side portion. A cover member is provided that is dimensioned for coupling with a removable cover of the cooler. The cover member has a rectangular main panel. The main panel has a pair of opposed foldable long edges and a pair of opposed foldable short edges. The cover member is secured to the base member whereby the cooler is completely contained therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the thermal wrap for coolers constructed in accordance with the principles of the present invention.

FIG. 2 is a front elevation view of the present invention.

FIG. 3 is a top plan view of the cover portion of the present invention.

FIG. 4 is a top plan view of the base portion of the present invention.

The same reference numerals refer to the same parts through the various figures.

DESCRIPTION OF THE PREFERRED EMBODIMENT

With reference now to the drawings, and in particular, to FIGS. 1 through 4 thereof, the preferred embodiment of the new and improved thermal wrap for coolers embodying the principles and concepts of the present invention and generally designated by the reference number 10 will be described.

Specifically, it will be noted in the various Figures that the device relates to a thermal wrap for coolers for increasing the thermal insulation of a cooler to preserve ice and maintain a cooling period for items disposed within the cooler. In its broadest context, the device consists of a base portion and a cover member. Such components are individually configured and correlated with respect to each other so as to attain the desired objective.

The base portion 12 is fabricated of an insulated material. The base portion 12 is dimensioned for wrapping around forward, rearward and opposing side walls of a cooler. Note FIGS. 1 and 2. The base portion 12 includes a forward portion 14, a rearward portion 16, a first side portion 18, and a second side portion 20. The forward portion 14 has a free leading edge and a trailing edge. The trailing edge is integral with a leading edge of the first side portion 18. A trailing edge of the first side portion 18 is integral with a leading edge of the rearward portion 16. A trailing edge of the rearward portion 16 is integral with a leading edge of the second side portion 20. The second side portion 20 has a free trailing edge. The first side portion 18 and the second side portion 20 each have an arcuate recess 22 extending inwardly of an upper edge thereof. When the base portion 12 is positioned around the cooler, the arcuate recesses 22 are positioned to leave exposed spaces for the pivot connection of a handle of the cooler on opposing sides thereof. Note FIG. 1. The base portion 12 has a strip of hook and loop material 24 disposed on an outer surface of the forward portion 14 inwardly of the leading edge thereof. The second side portion 20 has a strip of hook and loop material 26 disposed on an inner surface thereof inwardly of a trailing edge thereof for mating with the strip of hook and loop material 24 of the forward portion 14 for securement of the base portion 12 around the cooler. The forward portion 14 and the rearward portion 16 each have a strip of hook and loop material 28 on an outer surface thereof downwardly of an upper edge thereof.

The cover member 30 is dimensioned for coupling with a removable cover of the cooler. The cover member 30 has a rectangular main panel 32. The main panel 32 has a pair of opposed foldable long edges 34 and a pair of opposed foldable short edges 36. The long edges 34 each have a strip of hook and loop material 38 disposed on an inner surface thereof for mating with the strips of hook and loop material 28 on the forward and rearward portions 14,16 of the base portion 12 to facilitate securement of the cover member 30 to the base portion 12 whereby the cooler is completely contained therein. When the cover member 30 is positioned on the cover of the cooler, the short edges 36 will be contained against the base portion 12 by being disposed inwardly of the opposing segments of the handle of the cooler. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A thermal wrap for cooler s for increasing the thermal insulation of a cooler to preserve ice and maintain a cooling period for items disposed within the cooler comprising, in combination:

a base portion fabricated of an insulated material, the base portion dimensioned for wrapping around forward, rearward and opposing side walls of a cooler, the base portion including a forward portion, a rearward portion, a first side portion, and a second side portion, the forward portion having a free leading edge and a trailing edge, the trailing edge being integral with a leading edge of the first side portion, a trailing edge of the first side portion being integral with a leading edge of the rearward portion, a trailing edge of the rearward portion being integral with a leading edge of the second side portion, the second side portion having a free trailing edge, the first side portion and the second side portion each having an arcuate recess extending inwardly of an upper edge thereof, the base portion having a strip of hook and loop material disposed on an outer surface of the forward portion inwardly of the leading edge thereof, the second side portion having a strip of hook and loop material disposed on an inner surface thereof inwardly of a trailing edge thereof for mating with the strip of hook and loop material of the forward portion for securement of the base portion around the cooler, the forward portion and the rearward portion each having a strip of hook and loop material on an outer surface thereof downwardly of an upper edge thereof;

a cover member dimensioned for coupling with a removable cover of the cooler, the cover member having a rectangular main panel, the main panel having a pair of opposed foldable long edges and a pair of opposed foldable short edges, the long edges each having a strip of hook and loop material disposed on an inner surface thereof for mating with the strips of hook and loop material on the forward and rearward portions of the base portion to facilitate securement of the cover member to the base portion whereby the cooler is completely contained therein.

2. A thermal wrap for coolers for increasing the thermal insulation of a cooler to preserve ice and maintain a cooling period for items disposed within the cooler comprising, in combination:

a base portion fabricated of an insulated material, the base portion dimensioned for wrapping around forward, rearward and opposing side walls of a cooler, the base portion including a forward portion, a rearward portion, a first side portion, and a second side portion, the forward portion having a free leading edge and a trailing edge, the trailing edge being integral with a leading edge of the first side portion, a trailing edge of the first side portion being integral with a leading edge of the rearward portion, a trailing edge of the rearward portion being integral with a leading edge of the second side portion, the second side portion having a free trailing edge;

a cover member dimensioned for coupling with a removable cover of the cooler, the cover member having a rectangular main panel, the main panel having a pair of opposed foldable long edges and a pair of opposed foldable short edges, the cover member securing to the base portion whereby the cooler is completely contained therein.

3. The thermal wrap for coolers as set forth in claim 2 wherein the first side portion and the second side portion each have an arcuate recess extending inwardly of an upper edge thereof.

4. The thermal wrap for coolers as set forth in claim 2 wherein the base portion has securement means disposed on an outer surface of the forward portion inwardly of the leading edge thereof, the second side portion has securement means disposed on an inner surface thereof inwardly of a trailing edge thereof for mating with the securement means of the forward portion for securement of the base portion around the cooler.

5. The thermal wrap for coolers as set forth in claim 2 wherein the forward portion and the rearward portion each have securement means on an outer surface thereof downwardly of an upper edge thereof and the long edges of the cover member each have securement means disposed on an inner surface thereof for mating with the securement means on the forward and rearward portions of the base portion to facilitate securement of the cover member to the base portion whereby the cooler is completely contained therein.

* * * * *